US006302482B1

(12) United States Patent
Moll et al.

(10) Patent No.: US 6,302,482 B1
(45) Date of Patent: Oct. 16, 2001

(54) CHAIR HAVING A SEAT THAT IS ADJUSTABLE IN A HEIGHT AND WIDTH

(75) Inventors: Hellmuth Moll, Mühlhausen; Hans Looser, Wangen, both of (DE)

(73) Assignee: Moll System-und Funktions-Möbel GmbH, Gruibingen (DE)

( * ) Notice: Subject to any disclaimer, the term of this patent is extended or adjusted under 35 U.S.C. 154(b) by 0 days.

(21) Appl. No.: 09/481,013

(22) Filed: Jan. 11, 2000

(30) Foreign Application Priority Data

Jan. 14, 1999 (DE) ..... 199 01 076

(51) Int. Cl.[7] ..... A47C 1/02
(52) U.S. Cl. ..... 297/340; 297/353; 297/339
(58) Field of Search ..... 277/340, 339, 277/311, 353, 284.1

(56) References Cited

U.S. PATENT DOCUMENTS

| | | | |
|---|---|---|---|
| 252,169 | * | 1/1882 | Archer . |
| 2,310,366 | * | 2/1943 | Harman . |
| 5,193,880 | * | 3/1993 | Keusch et al. . |
| 5,303,982 | * | 4/1994 | Johnston . |
| 6,095,606 | * | 8/2000 | Opsvik . |

FOREIGN PATENT DOCUMENTS

| | | |
|---|---|---|
| 514 316 | 12/1971 | (CH) . |
| 2 032 464 | 1/1972 | (DE) . |
| 27 10 926 | 9/1978 | (DE) . |

* cited by examiner

*Primary Examiner*—Milton Nelson, Jr.
(74) *Attorney, Agent, or Firm*—Browdy and Neimark

(57) ABSTRACT

A chair composed of a seat adapted to be adjusted in height and depth, and a chair body, on which at least one rack rail extending in the direction of vertical adjustment is arranged, which is associated with the seat on which a vertically adjustable holding element runs, which is associated with the seat, the rack rail meshing with a gear wheel mounted on the holding element, and on which a drive element able to be rotated by the gear wheel is arranged. The holding element constitutes a projecting seat holding portion, on which a seat carrying part runs for movement in the direction of depth adjustment. The seat carrying part is connected via a flexible tension force transmitting element, as for example cord or a belt, in a driving manner, which flexible tension force transmitting element runs on the one hand in a manner free of slip around the drive element and on the other hand around a direction changing device and a section of the flexible tension force transmitting element extends along the seat holding portion in the direction of depth adjustment, on which section of the flexible tension force transmitting element the seat carrying part is secured.

12 Claims, 3 Drawing Sheets

CHAIR HAVING A SEAT THAT IS ADJUSTABLE IN A HEIGHT AND WIDTH

BACKGROUND OF THE INVENTION

The invention relates to a chair, more particularly for children and young persons, comprising a seat adapted to be adjusted in height and depth, a back rest arranged above the seat, a chair body adapted to be stood on the ground, on which at least one rack rail extending in the vertical direction is arranged and on which furthermore a holding means, associated with the seat, is adapted to run for adjustment in height, said holding means having a guide portion formed on it, a gear wheel arranged in a rotatable manner on the holding means, said gear wheel being in engagement with the rack rail, and drive means adapted to be caused to perform rotary movement by said gear wheel during vertical adjustment, said drive means being arranged on said holding means, said holding means constituting a seat holding part extending from its guide portion, on which holding portion a seat carrying part, connected with the seat is adapted to run in the direction of depth adjustment, said seat carrying part being drivingly connected with the drive means in such a manner that on resetting the holding means the seat is not only reset in height but automatically also in depth so that during its displacement upward or downward it simultaneously moves further forward or, respectively, rearward.

THE PRIOR ART.

In the case of a chair of this type described in the German patent publication 19,504,542 A1 the drive means are constituted by a drive pinion in mesh with a rack arranged on the seat carrying part so that rotation, occurring on displacement of the holding means in the height direction, of the drive pinion displaces the seat carrying part to the rear or to the front. In the case of this chair, the depth of the seat automatically adapts itself to the respective vertical position of the seat. This therefore renders the chair suitable for both children and also tall young persons and adults. In the case of a child the seat is lowered, it being simultaneously shifted to the rear so that the child may use the back rest. As the child grows he or she can use the seat after raising the seat, the seat being simultaneously so displaced forward that there is a comfortable sitting position leaning against the back rest.

In the case of the known chair the rack, and with it the seat carrying part, extends a comparatively great distance to the rear from the chair body. This leads to a bulky design, which impairs the appearance of the chair and involves the danger of injury to anyone moving past the chair and knocking against the rearwardly projecting rack rail.

SHORT SUMMARY OF THE INVENTION

One object of the invention is consequently to provide a chair of the type initially mentioned, in the case of which the resetting mechanism is designed in a compact manner.

In order to achieve these and/or other objects appearing from the present specification, claims and drawings, in the present invention the drive means is connected with the seat carrying part via flexible tension force transmitting means, as for instance a cord or a belt, to provide a driving connection, such driving means running on the holding means on the one hand free of slip around the drive means and on the other hand around direction changing means and comprise a section of the flexible tension force transmitting means extending along the seat holding part in the direction of depth adjustment, on which section of the flexible tension force transmitting means the seat carrying part is attached.

This means that the resetting of the seat carrying part is performed with the aid of flexible tension force transmitting means for instance a cable or the like. Such a flexible tension force transmitting means does not project to an unnecessary extent, since it may be redirected on either side of its section extending in the direction of the seat holding part.

A further advantage in comparison with the known rack is that the guide means seat carrying part does not have to be linear and may assume a curved path so that on resetting the position of the of the seat there is also a change in the slope of the seat.

The design in accordance with the invention is furthermore comparatively inexpensive.

The back rest is to be arranged at different distances above the seat for tall and short persons. Consequently in the case of known chairs the back rest has been designed to be adjusted in height. However frequently there is no possibility of such back rest adjustment, either because the designer forgot about it or because its use would be too inconvenient of the user.

In this connection there is a provision in accordance with a preferred embodiment of the novel chair such that the holding means is associated with the back rest as well, and forms a rest holding portion, which is borne by its guide portion, and is arranged above the seat holding portion, and on which a rest carrying part (which is connected the back rest) runs in a sliding manner in a vertical rest resetting direction, which carrying part which is drivingly connected with the drive or other drive means on the holding means (which during resetting of the height of the holding means is driven by the gear wheel or by another gear wheel on the holding means, which gear wheel is in engagement with the rack rail or another rack rail on the chair body) is driven via flexible tension transmitting means as for example a cord or a belt, which flexible tension force transmitting means are trained at the holding means on the one hand free of slip around the drive means or the other drive means and on the other hand are trained around further direction changing means and the flexible tension force transmitting means possess a section extending at the rest holding means in the direction of rest resetting in, on which section the rest carrying part is locked in such a manner that on displacement of the holding means upward or downward the vertical distance apart between the seat and the back rest becomes larger and, respectively, smaller.

This means that the vertical distance between the seat and the back rest is automatically reset, when the seat height is changed by displacement of the holding means. The back rest thus also takes part on the one hand in the displacement of the holding means with the seat in the height reset direction of the holding means and on the other hand is shifted in relation to the holding means so that with an increase in the height of the seat there will be a greater distance between the rest and the seat.

If the rest is provided with an gear wheel and/or another drive means, then by selection of suitable diameters the displacements performed on resetting the holding means, of the seat and of the rest in the depth direction and, respectively, in the vertical reset direction of the rest, may be separately set by the designer independently of one another. On the contrary in the case of equal reset displacements of the seat and of the rest there will be—ignoring a few exceptions—a seat design which is suitable for most persons so that both reset displacements may be controlled and driven by a single gear wheel and such movements may be driven by the same drive means, something which is particularly simple and economic.

Further advantageous developments of the invention are defined in the claims.

Convenient developments and forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENT OF THE INVENTION

Figure 1:
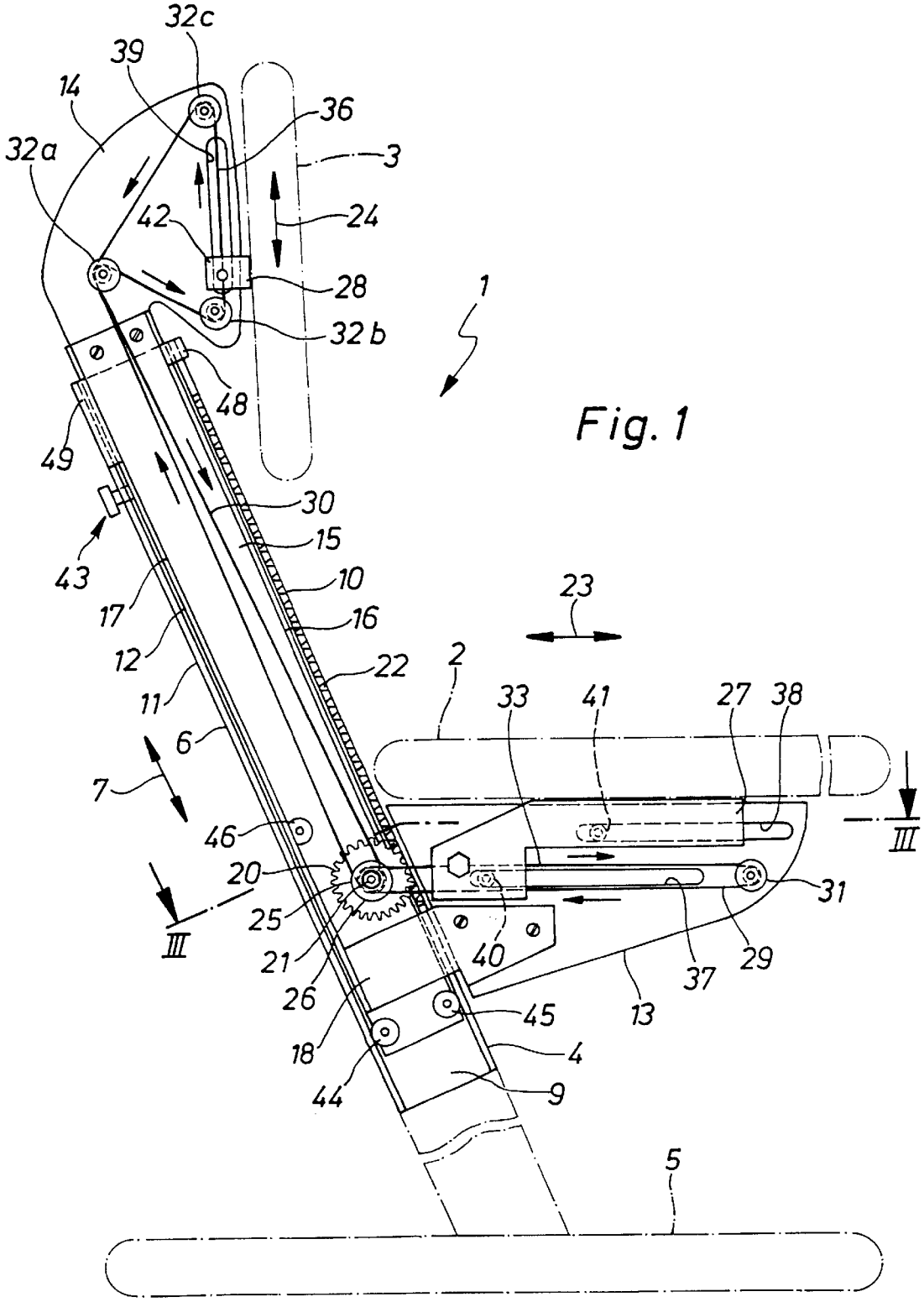
FIG. 1 shows the resetting mechanism of a chair in accordance with the invention in a diagrammatic lateral elevation, the seat and the back rest and furthermore the bottom portion of the chair body being indicated in chained lines.

The chair 1 illustrated diagrammatically in the drawing intended for children and young persons, can be changed in size as they grow. For this purpose the seat 2 is able to be adjusted in height while being automatically reset simultaneously forward and, respectively, backward with oppositely directed changes in the depth direction so that at a greater seat height there is simultaneously a greater seat depth. The chair 1 furthermore possesses a back rest 3 for the seated person to lean against. The depth reset accompanying the vertical adjustment of the seat renders it possible for both small persons, that is to say more particularly children, for whom the seat 2 assumes a downwardly shifted position, and also larger persons, in the case of which the seat 2 is shifted upward, to use the back rest.

The back rest 3 partakes in the vertical resetting of the seat 2 and thereby performs an additional movement in the vertical direction so that the vertical distance from the seat 2 is changed. This distance becomes larger or smaller on resetting the seat 2 upward or, respectively, downward so that the rest 3 is in a comfortable position both for a small person with the seat set at a low level and also for person with the seat set at a higher level.

Furthermore the chair 1 possesses stand-like a body 4, which includes a foot means 5 supporting the chair body on the ground or floor.

The adjustment mechanism indicated in the figures may be present only once over, i. e. in the middle of the chair, or more than once, as for example once on each side of the chair. Each such adjustment mechanism is provided with a guide element 6 on the chair body 4 which extends in the vertical adjustment direction 7 of holding means 8, guided by it, of the adjustment mechanism. In this respect the guide element 6 has linear form along the adjustment range of the holding means 8, it extending in the embodiment at a slope to the vertical obliquely to the rear and upward. In the illustrated working embodiment the guide element 6 is manufactured of metal and is constituted by a piece of section, with a U-cross section, a transverse web 9 and two limbs 10 and 11 extending perpendicularly therefrom.

Prior to embarking on further details, it is pointed out that the adjustment mechanism can be concealed in the finished chair. The elements above mentioned for this are omitted in the drawings.

As already mentioned the adjustment mechanism illustrated comprises an holding means 8, which is associated with the seat 2 and also the back rest 3. In this respect the holding means 3 constitutes a guide portion 12 on the chair body 4 able to be adjusted in the vertical direction 7 and in the embodiment running on the guide element 6, from which guide portion 12 there extends on the one hand at its bottom end a seat holding portion 13, which also belongs to the holding means 8, to the side of the seat 2 and on the other hand, in the working example at its top end, a rest holding portion 14, arranged above the seat holding portion 14, of the holding means 8. The guide portion 12 of the holding means 8 is mounted in a telescoping manner on the guide element 6 of the chair body 4, the guide portion 12 extending in front of the guide element 6. In the illustrated working embodiment the guide portion 12 runs within the guide element 6. In this respect at least in its top part the illustrated guide portion 12 has a U-like cross section with a guide portion transverse web 15, which is adjacent to the guide element transverse web 9, and two guide portion limbs 16 and 17, which are adjacent to the guide element limbs 10 and 11. At the level of the seat holding portion 13 the guide portion limb 16, which faces the seat 2, is interrupted or is completely omitted at this point.

The guide portion 12, the seat holding portion 13 and the rest holding portion 14 of the holding means 8 preferably also consist of metal. In this respect the seat holding portion 13 and/or the rest holding portion 14 possess a tabular or plate-like configuration in the illustrated case. In practice they may obviously be designed in a different fashion.

The seat holding portion 13 and the rest holding portion 14 are suitably attached to the guide portion 12. In the illustrated working embodiment the seat holding portion 13 is connected via an intermediate member 18 with the guide portion 12, said intermediate member being screwed to the guide portion 12 and projects past the guide element 6 to the side of the seat 2, the seat holding portion 13 being screwed to the projecting portion 19 of the intermediate member 18. The rest holding portion 14 may also be screwed to the guide portion 12, that is to say to the transverse web thereof in the embodiment of the invention.

The seat holding portion, the rest holding portion and the guide portion may however be joined together in some other fashion, as for example by being designed integrally.

On the holding portion 8, and preferably on its guide portion 12, a gear wheel 20 is rotatably mounted, the shaft 21 thereof being on the transverse web 15 of the guide portion 15. The gear wheel 20 is in mesh with a rack rail 22, which is arranged on the chair body 4 and on the guide element 6 and extends in the vertical direction. In the illustrated working embodiment the rack rail 22 is formed on the free edge of the guide element limb 10 turned toward the seat 2. For the gear wheel 20 to be able to be in engagement with the rack rail 22, in this region the limb 16 of the guide portion 12 is cut away.

If for resetting the vertical position of the seat 2 the holding means 8 is displaced in the vertical resetting direction 7 corresponding to the course of the guide element 6, the gear wheel 20 will be turned in one or the other direction. It is from this rotary movement that both the movement of the seat 2 in the depth reset direction 23 and also the movement of the back rest 3 in relation to the holding means 8 in the rest height resetting direction 24 are derived. For this purpose there are drive means 25 driven by the gear wheel 20 during its rotary movement, such drive means 25 playing a part both in resetting the seat and also in resetting the rest and being constituted by a drive pulley 26. The drive means 25 and, respectively, drive pulley 26 are preferably arranged to be coaxial to the gear wheel 20 and connected with same in a rotation transmitting manner. The arrangement is in this respect such that a seat carrying part 27, which is connected with the seat 2, runs on the seat holding portion 13 in the depth reset direction 23 and a rest carrying part 28, which is connected with the back rest 3, runs on the rest holding portion 14 in the rest height reset direction 24. Both the seat carrying part 27 and also the rest carrying part 28 are connected with the drive pulley 26 in a driving manner so that on resetting the holding means 8 upward or downward the seat 2 is reset not only in the vertical direction but also automatically in the depth direction (direction 23) to the front or, respectively, to the rear and furthermore the vertical distance between the seat 2 and the back rest 3 becomes smaller and, respectively, smaller.

The drive pulley 26 is on the one hand connected with the seat carrying part 27 and on the other hand with the rest carrying part 28 via a flexible tension force transmitting means 29 and, respectively, 30, which for example may be in the form of a cord or a belt, and more particularly a wire cable arrangement. The flexible tension force transmitting means 29 is on the one hand trained past the holding means 8 free of slip around the drive pulley 26 and on the other hand around direction changing or bend means 31 arranged on the seat holding portion. It is in this manner that the flexible tension force transmitting means 29 is arranged to run in a loop, it having a section 33 running along the seat holding portion 13, on which section the seat carrying part 27 is attached. This attachment may for instance be by clamping. For this purpose there are the conventional possibilities, as for instance having a bolt 24 on the seat carrying part, such bolt having a transverse hole through it, through which the flexible tension force transmitting means section 33 is threaded. The flexible tension force transmitting means section 33 extends between the seat carrying part 27 and a screw nut 35, screwed on the bolt 34, or the like so that it is clamped fast against the seat carrying part 27 on doing the screw nut 35 up tight.

In the case of the flexible tension force transmitting means 39 for the rest 3 the design is similar. This flexible tension force transmitting means as well is trained at the holding means 8 in a slip-free manner around the drive pulley 26 and on the other hand around further direction changing means 32*a,* 32*b* and 32*c* so that it is in the form of a loop, the flexible tension force transmitting means 30 furthermore having a flexible tension force transmitting means section 36 running at the rest holding portion 14 in the direction of reset of the rest in the vertical direction 24, the rest carrying part 28 being secured to the carrying part 28. Such attachment can be in a manner similar to the attachment of the flexible tension force transmitting means 29 to the seat carrying part 27 or in some other suitable fashion.

Figure 3:
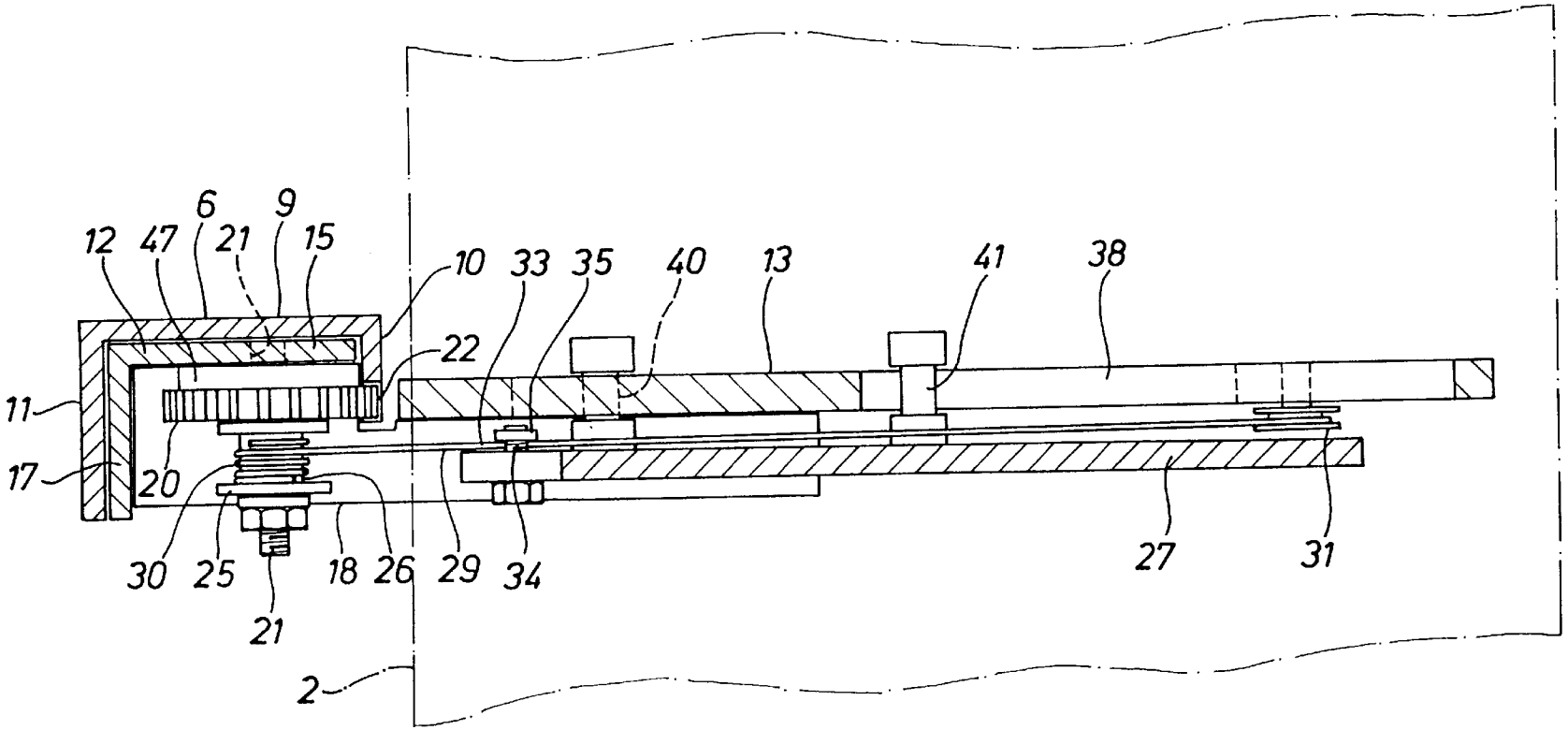
FIG. 3 shows the arrangement of FIG. 1 in a section taken on the line III—III.

The two flexible tension force transmitting means 29 and 30 for the seat 2 and, respectively, the rest 3 are in the illustrated working embodiment constituted by a common, continuous flexible tension force transmitting means in the form of a wire cable, whose two ends are secured to the drive pulley 26. In this respect it is possible for the continuous cable, as is illustrated in FIG. 3, to have a few turns thereof wound around the drive pulley 26.

The two flexible tension force transmitting means 29 and 30 might however be separately attached to the drive pulley 26.

At this point it is noted that departing from the working embodiment it would be possible to associate the two cable-like drives with different rack rails and/or gear wheels and/or drive means so that besides the rack rail 22 another rack rail and/or in addition to the gear wheel 20 an other gear wheel and/or in addition to the drive pulley 26 another drive pulley would be present. If two gear wheels and/or two drive pulleys with different diameters were to be selected, different transmission ratios would be produced for seat resetting and the resetting of the rest.

In the illustrated embodiment the drive pulley 26 has the same diameter from end to end and is, as mentioned, associated with both flexible tension force transmitting means 29 and 30. In this connection there is a further possibility in which a different drive means would be associated with each flexible tension force transmitting means 29 and 30, the two drive means being respectively constituted by a drive pulley or the like with a different diameter,in which case however they would be arranged, as in the embodiment, in common coaxially with the gear wheel 20.

Instead of the roller-like configuration of the drive pulley 26 it would be possible to have a drive wheel with a smaller axial extent, more especially if the two flexible tension force transmitting means 29 and 30 are trained over two separate drive wheels.

Figure 2:
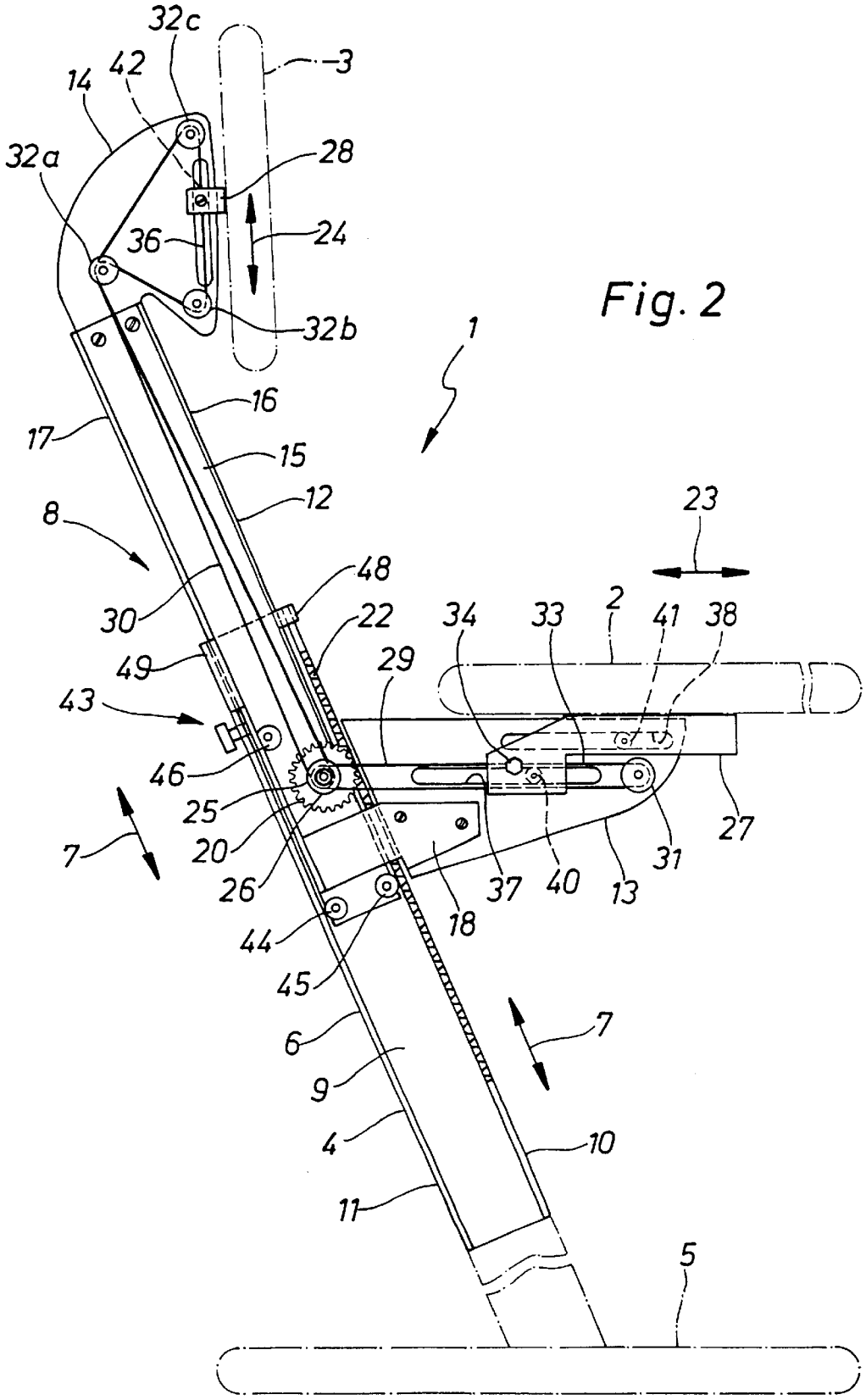
FIG. 2 shows the arrangement of FIG. 1, the holding means for the seat and the back rest being reset at a higher level and the seat assuming a position further up and the seat assuming a further forward position in order to increase the seat depth and the back rest having been moved further up in relation to the holding means to increase the distance from the seat.

The direction changing or bend means 31 and the further direction changing means 32*a,* 32*b* and 32*c* are preferably constituted by rotatably mounted bend pulleys or bend wheels. In the illustrated embodiment a single such bend permanent 31 is arranged on the seat holding portion 13, whereas on the rest holding portion 14 three such bend pulleys 32*a,* 32*b* and 32*c* are provided. This is however only of lesser importance, because the number and the position of the bend pulleys or bend wheels is determined by the local circumstances. The only point which is important is that the two flexible tension force transmitting means sections 33 and 36 are present, which extend in the depth adjustment direction 23 and, respectively, in the vertical adjustment direction 24 and to which the seat carrying part 27 and, respectively, the rest carrying part 28 are secured. In FIG. 1 the cable constituting the flexible tension force transmitting means 29 and 30 performs the movement as indicated by the arrows, when the holding means 8 is reset upward into the position indicated in FIG. 2.

The carrying part 27 for the seat 2 is able to be shifted in the depth reset direction 23 while being guided by the seat holding portion 13. Accordingly the part 28 carrying for the back rest 3 slides on the rest holding portion 14 of the holding means 8. For this purpose the seat holding portion 13 has two guide slots 38 and 38 extending in the depth reset direction 23 for the seat, while in the rest holding portion 14 a guide slide 39 is provided extending in the direction of resetting of the rest in the vertical direction. The number of the guide slots could however be different. Into each guide slot there fits a guide member 40, 41 and, respectively, 42 arranged on the seat carrying part 27 and, respectively, on the rest carrying part 28. In the illustrated working embodiment the guide slots 37, 38 and 39 are linear. They could however have a different form and not be straight, if it were desired to change the slope of the seat and back rest simultaneously with resetting the depth of the seat and, respectively, resetting the height of the rest.

The holding means 8 may be locked in the respectively set vertical position. For this purpose it is possible for there to be a clamping means 43 for clamping the I holding means 8 against the chair body, in the embodiment against the guide element 6. It may for instance be a question of a locking bolt screwed into the chair body and which thrusts the holding means, in the working example its guide portion 12, against the chair body. Alternatively a clamping means could be provided adapted to clamp the flexible tension force transmitting means 29 or 30 on the holding means 8. It will be clear that the clamping or securing function could be performed with a different securing means, which would come into engagement at a different point.

It will be furthermore seen from the drawings that guide pulleys 44, 45, 46 and 47 are arranged on the guide portion 12 of the holding means 8, with which pulleys the guide portion 12 is guided on the chair body and thus on its guide element 6.

As already mentioned the chair body guide element 6 in the working embodiment possesses a U-like cross section, into which the guide portion 12 fits. In this connection it is to be added that the guide portion 12 of the holding means 8 is overlapped on the open side of the guide element 6 by holding means 48 and 49*a* thereon so that the guide portion 12 is not able to move out of engagement with the guide element 6.

What is claimed is:

1. A chair, more particularly for children and young persons, comprising a seat adapted to be adjusted in height and depth, a back rest arranged above the seat, a chair body adapted to be stood on the ground, on which at least one rack rail extending in the vertical direction is arranged and on which furthermore a holding means, associated with the seat, is adapted to run for adjustment in height, said holding means having a guide portion formed on it, at least one gear wheel arranged in a rotatable manner on the holding means, one said gear wheel being in engagement with one said rack rail, and at least one drive means adapted to be caused to perform rotary movement by said one gear wheel during vertical adjustment, said at least one drive means being arranged on said holding means, said holding means constituting a seat holding part extending from its guide portion, on which seat holding part a seat carrying part, connected with the seat is adapted to run in the direction of depth adjustment, said seat carrying part being drivingly connected with said at least one drive means in such a manner that on resetting the holding means the seat is not only reset in height but automatically also in depth so that during its displacement upward or downward it simultaneously moves further forward or, respectively, rearward, wherein said at least one drive means is connected with the seat carrying part via flexible tension force transmitting means to provide a driving connection, the tension force transmission means running on the holding means free of slip around the drive means and around seat direction changing means and having a section extending along the seat holding part in the direction of depth adjustment, on which section of the flexible tension force transmitting means the seat carrying part is attached.

2. The chair as set forth in claim 1, wherein the holding means is associated with the back rest as well and forms a rest holding portion, arranged above the seat holding part, which is borne by the guide portion, and on which rest holding portion a rest carrying part, which is connected to the back rest, runs in a sliding manner in a rest height resetting direction, which carrying part is drivingly connected with a said drive means which during resetting of the height of the holding means is driven by a said gear wheel which is in engagement with a said rack rail and is driven via said flexible tension transmitting means trained at the holding means free of slip around one said drive means and trained around further direction changing means and the flexible tension force transmitting means possess a section extending at the rest holding portion in the rest height resetting direction, on which section the rest carrying part is set in such a manner that on displacement of the holding means upward the vertical distance between the seat and the back rest becomes larger and on displacement of the holding means downward the vertical distance between the seat and the back rest becomes smaller.

3. The chair as set forth in claim 1, wherein one said drive means are arranged coaxially in relation to one said gear wheel and are connected in such a manner as to prevent relative rotation.

4. The chair as set forth in claim 1, wherein one said drive means are constituted by one of a drive pulley and a drive gear wheel.

5. The chair as set forth in claim 1, wherein the holding means is associated with the back rest as well and forms a rest holding portion, arranged above the seat holding part, which is borne by the guide portion, and on which rest holding portion a rest carrying part, which is connected to the back rest, runs in a sliding manner in a rest height resetting direction, and there is one said drive means associated with both the seat carrying part and also the rest carrying part, the drive means associated with the seat carrying part and the flexible tension force transmitting means associated with the rest carrying part are constituted by a common continuous flexible tension force transmitting means.

6. The chair as set forth in claim 1, wherein said flexible tension transmitting means are trained at the holding means free of slip around one said drive means and trained around further direction changing means facing the back rest and the flexible tension force transmitting means possess a section extending at the rest holding portion in a rest height resetting direction, and one of the seat direction changing means and the further direction changing means are constituted by one of at least one rotatably mounted bend pulley and a rotatably mounted bend wheel.

7. The chair as set forth in claim 1, wherein the holding means is associated with the back rest as well and forms a rest holding portion, arranged above the seat holding part, which is borne by the guide portion, and on which rest holding portion a rest carrying part, which is connected to the back rest, runs in a sliding manner in a rest height resetting direction, at least one of the seat holding part and the rest holding portion comprises at least one guide extending in one of the direction of depth adjustment of the seat and a rest height resetting direction, and a guide member arranged to run on one of the seat carrying part and the rest carrying part.

8. The chair as set forth in claim 1, comprising a locking means for locking the holding means in a selected vertical position.

9. The chair as set forth in claim 8, wherein said locking means are a clamping means for clamping the holding means to the chair body.

10. The chair as set forth in claim 8, wherein said locking means are a clamping means for clamping the flexible tension force transmitting means to the holding means.

11. The chair as set forth in claim 1 wherein said flexible transmitting means comprise one of a cord and a belt.

12. The chair as set forth in claim 2 wherein said flexible transmitting means comprise one of a cord and a belt.

* * * * *